US006354305B1

(12) United States Patent
Janouch et al.

(10) Patent No.: US 6,354,305 B1
(45) Date of Patent: Mar. 12, 2002

(54) HAIR STYLING APPLIANCE AND HAIR STYLING METHOD

(75) Inventors: Peter Janouch, Frankfurt am Main; Heinz Kern, Königstein; Peter Ruppert, Karben; Norbert Schaefer, Frankfurt am Main, all of (DE)

(73) Assignee: Braun GmbH (DE)

( * ) Notice: Subject to any disclaimer, the term of this patent is extended or adjusted under 35 U.S.C. 154(b) by 0 days.

(21) Appl. No.: 09/547,570

(22) Filed: Apr. 12, 2000

Related U.S. Application Data

(63) Continuation of application No. PCT/EP98/06092, filed on Sep. 24, 1998.

(30) Foreign Application Priority Data

Oct. 31, 1997 (DE) ..... 197 48 067

(51) Int. Cl.[7] ..... A45D 1/04; A45D 1/00; A45D 7/04

(52) U.S. Cl. ..... 132/232; 132/269; 132/207

(58) Field of Search ..... 132/232, 229, 132/233, 269, 271, 207; 219/225, 222, 223, 224, 226

(56) References Cited

U.S. PATENT DOCUMENTS

| | | | | |
|---|---|---|---|---|
| 3,660,634 A | | 5/1972 | Scott | |
| 4,169,007 A | * | 9/1979 | Pray | 156/380 |
| 4,365,140 A | * | 12/1982 | Bast et al. | 219/225 |
| 4,602,143 A | | 7/1986 | Mack et al. | |
| 4,695,704 A | | 9/1987 | Andis | |
| 4,740,669 A | * | 4/1988 | Takimae | 219/225 |
| 4,841,127 A | | 6/1989 | Prager et al. | |
| 4,851,641 A | | 7/1989 | Barowski et al. | |
| 5,868,146 A | | 2/1999 | Henninger et al. | 132/232 |

FOREIGN PATENT DOCUMENTS

| | | |
|---|---|---|
| DE | 3215232 A1 | 10/1983 |
| WO | WO 97/42848 | 11/1997 |

* cited by examiner

*Primary Examiner*—John J. Wilson
*Assistant Examiner*—Robyn Kieu Doan
(74) *Attorney, Agent, or Firm*—Fish & Richardson P.C.

(57) ABSTRACT

The present invention relates to a hair styling appliance comprising a handle portion and a heating portion with a preferably dome-shaped heating zone for heating and styling hair, and a cooling portion with a cooling zone for cooling the hair thus styled, wherein the difference in temperature between the surface temperatures of the heating zone and the cooling zone amounts to at least 80 kelvin and, more particularly, 100 kelvin. The present invention also relates to a method of styling hair, especially using a hair styling appliance with the above-mentioned features.

32 Claims, 10 Drawing Sheets

HAIR STYLING APPLIANCE AND HAIR STYLING METHOD

This is a continuation of PCT application Ser. No. PCT/EP98/06092, filed Sep. 24, 1998, which claims priority from German application serial number 19748067.5, filed Oct. 31, 1997, (pending).

The present invention relates to a hair styling appliance with a handle portion, a heating portion with a preferably dome-shaped heating zone for heating and styling, especially curls or waves of hair, and a cooling portion with a cooling zone for cooling the styled hair. Further, the present invention relates to a method of styling hair, especially by means of the hair styling appliance of the present invention.

Appliances and methods of the above-mentioned type are known from the state of the art. German patent application No. 32 15 232, for example, discloses a method of styling a strand of hair by heating and a hair styling appliance for this purpose. In this arrangement, the air supplied by an air blower is conducted partly via a filament winding to a heated air chamber of a cylindrical curler member and exits through radial heated-air discharge openings. Cooling air enters into a cooling air chamber of the curler member through a bypass channel which is passed by the heating filament. The hair strand to be styled is wrapped around the curler member which is then moved away from the scalp, with the hair strand initially sliding over the outside wall of the heated air chamber and subsequently over the outside wall of the cooling chamber. The hair strand is heated and cooled thereafter. However, a tool of this type does not permit achieving satisfying results, because the waves and/or curls thereby produced in the hair are not sufficiently permanent.

A similar appliance and a method is also described in non-published application PCT/EP97/02064 of the applicant which, by express reference, is herewith included in the disclosure of the present patent application. The said application discloses a hair styling appliance with a handle portion, a heating portion with a heating zone for heating the hair, a cooling zone and a styling element for styling the hair. The styling element is configured as a styling edge, with this styling edge being arranged subsequent to the heating zone and the cooling zone following the styling edge so that a hair strand being styled can be heated at the heating zone, the heated hair strand can be styled at the styling edge, and the so restyled hair strand can be cooled in the cooling zone. This application further includes a method of styling hair, especially implemented in a hair styling appliance according to the previous description.

On the one hand, it is not possible with the hair styling appliances known from the prior art to produce a permanent curl or wave in a strand of hair. On the other hand, a complicated construction is necessary, or handling of the appliance is intricate for the user, especially when curling or waving hair.

SUMMARY OF THE INVENTION

An object of the present invention is to provide a hair styling appliance which is improved compared to the state of the art and a method of employing the hair styling appliance so as to ensure a maximally permanent set for a hair strand which is styled by way of the appliance, more particularly, a curl or wave in a hair strand which is produced by way of the appliance and, respectively, the method. On the other hand, an additional objective of the appliance is to render possible simple handling by a user, with the handling necessitating only few and simple manipulations.

According to the present invention, this object is achieved, on the one hand, by a hair styling appliance which includes a handle portion, a heating portion with a preferably domeshaped heating zone for heating and styling, especially curls or waves of hair, and a cooling portion with a cooling zone for cooling the styled hair, wherein the difference in temperature between the surface temperatures of the heating zone amounts to at least 80 kelvin, more particularly, 100 kelvin, or more. This object is achieved, on the other hand, by a method which suggests using the appliance of the present invention. An object of this type provides for a hair styling appliance which requires little effort and structure and is easy to handle due to its simple design. Favorably, the object of the present invention achieves an improved permanence of the curls or waves of a hair strand is reached because "freezing" of the styled hair, especially the curls or waves in a hair strand, occurs only with a temperature difference of at least 80 kelvin between the heating and cooling zones, which is essential for the present invention, with the result of permitting an improved permanence of the curls. Thus, the object of the present invention discloses a hair styling appliance which is advantageously adapted for treatment of straight, curled, or waved hair.

In a favorable aspect of the present invention, the heating and cooling portions together provide a styling member for hair treatment, with the styling member generally having a circular, elliptical, or similar cross-sectional surface. This provides a simple handling with the heating and cooling portions incorporated in one single styling member. In addition, an essentially symmetrical arrangement of the cross-sectional surface of the styling member for the heating and cooling portions, for example, in two semicircular cross-sections, permits achieving a heating zone and a cooling zone of generally equal size. This has proved advantageous for a sufficient heating and subsequent cooling.

In an improvement of the present invention, the heating and cooling zones are arranged on the outer surfaces of the heating and cooling portions, which are dome-shaped in particular, so that favorably the maximum possible surface for heating and/or cooling is made available. The especially plane inside surfaces of the heating and cooling portions are arranged so as to be opposite and spaced from each other, with the result that a minimum possible temperature influence of the heating portion on the cooling portion and vice-versa occurs. Preferably, the distance between the two inner surfaces amounts to 1.5 to 3 mm approximately.

Advantageously, a thermal uncoupling element, for example, an insulator, is provided between the heating portion and the cooling portion so that it is almost ruled out that the temperatures of the two components will influence each other.

In a particularly favorable embodiment of the present invention, a pressing means, for example, a hair retaining clip for exerting a pressing force on the hair being styled is provided. Strands of hair can be placed between the heating portion and the pressing means. A good heat contact of the hair with the heating portion is thereby achieved, on the one hand, and a tension force acting on the hair can be produced, on the other hand, which must be exerted by a user when the hair styling appliance, starting from the hair roots, is pulled over the strand of hair.

The pressing means, more particularly, the clip, is movably attached to the handle portion or the heating portion of the appliance. Especially, one end of the clip is coupled by a pivot to the handle portion or the heating portion and urged by a spring element against the heating portion. Also, the clip may be so fixed that a uniform gap is produced between it and the heating portion when it in its unloaded inactive position, i.e., when no hair is placed between clip and heating portion. The tension force can favorably be set to the desired amount by an appropriate selection of the spring element and the gap size. Preferably, the tension force that is necessary to pull the hair styling appliance from the strand ranges between 1 and 2 Newton.

The present invention further discloses manufacturing the clip from a heat-conducting material so that it favorably also heats the hair strand.

In a preferred aspect of the present invention, the heating portion comprises a member made of an appropriate heat conducting material, for example, metal, or a similar material. The surface temperature of this member in the area of the heating zone amounts to at least 120° C., preferably however about 145° C., in order to reach the styling temperature of roughly 120° C. required in the hair with a relative moisture of roughly 30% in the hair.

The heating portion itself includes an electric heating element, for example, a PTC element, an electric heating spiral, or a similar member. As an alternative, however, the heating portion may also been heated by a gas heating appliance, e.g. a heating appliance with catalytic combustion. It is especially advantageous, however, to position a PTC element in the heating portion.

In another preferred aspect, the cooling portion comprises a member made of metal, such as aluminum, or also plastics, or the cooling portion has a heat-conducting coating and/or cooling ribs. This provides the best possible heat dissipation of the hair which is previously heated and then passed over the cooling portion so that the temperature difference is adjustable which is necessary for successfully styling curls.

What has been found to be especially favorable is a cooling portion which comprises a cooling member that can be cooled actively, for example, a member which can be cooled by cooling air, a Peltier element, or a similar element. An arrangement of this type permits adjusting the temperature difference according to the present invention in a particularly advantageous manner so that particularly good styling results and a great degree of permanence of the curls can be achieved by means of an actively cooled cooling member.

In another embodiment of the present invention, it is proposed that the cooling portion, and/or the clip, and/or the heating portion have guiding and/or spacing means, more particularly ribs, on the outer surface. On the one hand, the said means advantageously permits guiding the hair strands adapted to be wrapped around the styling member of the appliance and, on the other hand, the means, in its capacity as a spacing means, prevents a user from getting into contact with the hot surface of the heating portion, or, respectively, the clip.

The ribs are arranged substantially transversely to the main axis of the appliance so that two adjacent ribs form in each case a channel that is circumferential to the heating portion, and/or the cooling portion, and/or the clip. Favorably, the hair strand being styled can simply be placed into the channel which allows safely guiding the hair strand.

At least one rib of the hair styling appliance is adapted as a boundary rib so that the hair strand which is wrapped around the heating portion and/or the cooling portion is secured by this rib against slipping off from the heating portion, the clip, and/or the cooling portion in a favorable fashion.

In a special embodiment, the two external ribs of the cooling portion are designed as boundary ribs so as to project over the remaining ribs, in particular those at the cooling portion, in a plane transverse to the main axis of the appliance at least in areas. This achieves guiding of the hair strand which is adapted to be wrapped around an area of the hair styling appliance, thereby preventing the strand from either slipping off from the tip of the appliance towards the front or from the handle portion of the appliance towards the rear end.

Preferably, the ribs are provided on at least one component part, especially the clip, in a bow-shaped, waved or arrow-shaped configuration. It is advantageously achieved with this design of the ribs that the strand which is wrapped around this component part experiences a higher amount of friction than on the other component part, especially the cooling portion. The reason is to prevent the user from pulling the hair strand across the outer surface of the clip.

In a special design, the ribs of the clip are arranged generally in parallel to the main axis of the appliance. This is meant to expediently provide both an optical barrier and a mechanical obstacle, particularly by an increased frictional resistance of the hair in order to prevent the user from pulling the hair across the outer surface of the clip.

In a particularly favorable manner, the ribs are arranged substantially radially in relation to the main axis of the appliance. Thus, the ribs extend substantially vertically outwards from the outer surface of the appliance, escpecially, from the clip or the cooling portion.

In another embodiment of the present invention, the appliance, especially the handle portion, has a generally elliptical, oval, or similar outside contour in a plane that is vertical to its main axis. The advantage of such a handle portion configuration is that the handle feels more pleasant in the hand of a user, and the user finds it uncomfortable to turn the hair styling appliance around its longitudinal axis several times, as is common with the majority of hair curling irons of the art. The object of this handle portion configuration is to contribute to the novel type of handling of the appliance which clearly distinguishes over the use of state-of-the-art appliances inasmuch as the appliance, other than a curling iron which is turned several times around its longitudinal axis and with the hair being wrapped around a curler member, is pulled away from the hair roots of a user.

The cross-sectional surface of the handle portion decreases continuously from the front towards the rear free end of the handle so that, advantageously, the user is enabled to grip the appliance in a comfortable and ergonomical way.

In a special design of the present invention, which can also represent an independent invention, a method of styling hair is disclosed, more particularly, with a hair styling appliance of the present invention, wherein initially a hair strand that is to be styled, especially dry hair, is heated at a heating zone of a heating portion, styled by way of a preferably dome-shaped surface of the heating zone, and the so heated and styled hair strand is subsequently cooled at a cooling zone. According to the present invention, the surface temperatures of the heating zone and the cooling zone are set so that the temperature difference between both zones amounts to at least 80 kelvin, in particular, 100 kelvin, or more. It is necessary for application that the temperature difference of the present invention is reached or exceeded in order to render possible a sufficient cooling of the heated hair strand and "freezing" of the previously styled hair strand, especially the curl, so that a permanent curl can favorably be produced.

Advantageously, the hair is heated in the heating zone at least to a styling temperature, with the latter temperature, also called glass temperature Tg, e.g. amounting to roughly 120° C., with a relative moisture in the hair of 30% approximately. A particularly advantageous result is achieved with the method of the present invention when the surface temperature of the heating zone preferably amounts to 145° C. approximately.

To achieve appropriate curling results, the hair is pulled in a tightened condition over the heating zone and the cooling zone. Shaping curls is favored by this tightened condition of the hair.

To produce the necessary tightening of the hair, the hair is placed into a clamping area between a pressing means, such as a hair retaining clip, and the heating portion, and a clamping force is thereby applied to the hair being styled. The heated hair is then pulled through the clamping area and along the cooling zone. The retaining force which is produced by the retaining clip in this movement counteracts the tension force which must be generated by the user for the movement of the hair styling appliance relative to the hair.

The direction of movement of the hair behind the heating zone, that means after the hair has left the clamping area, is equal to the direction of movement in the heating zone. This permits a uniform and favorably low tension force on the hair. A change in the direction of movement of the hair is thus favorably avoided. The shape and permanent set of the curls can be influenced by the relative speed between the hair styling appliance, especially the styling member, and the hair. Thus, a slow movement of styling member and hair favorably achieves a styled curl of small size, while a quick passage achieves a generously styled curl or wave.

Favorably, the method of the present invention permits effectively curling straight hair from the roots to the tip of the hair without the use of a curler member which was required in the majority of the previously known methods. Further, the hair styling process attainable with this method is reversible.

As an alternative, the method of present invention also permits straightening curled or waved hair by configuring the heating and cooling zones as plane areas arranged one behind the other, for example.

It is suggested for a particularly favorable application of this method that the hair be placed particularly close to the hair roots into the clamping area between heating portion and hair retaining clip, and that the hair styling appliance is turned about its main axis by roughly 120° to 180° so that the hair will bear against the heating zone and at least in areas against the cooling zone of the cooling portion. Subsequently, the hair styling appliance is moved away from the head of a user. The heated and styled hair is cooled at the cooling zone of the cooling portion, i.e., the styled, especially curled or waved hair is "frozen" by the temperature difference according to the present invention between the surface temperatures of the heating zone and the cooling zone of at least 80 kelvin.

Further features, advantages and possible applications of the present invention can be seen in the following description of embodiments which are illustrated in detail in the accompanying drawings. All features described and/or illustrated, individually or in any desired combination, form the object of the present invention, irrespective of their combination in the claims and their appendency.

DETAILED DESCRIPTION

Figure 1:
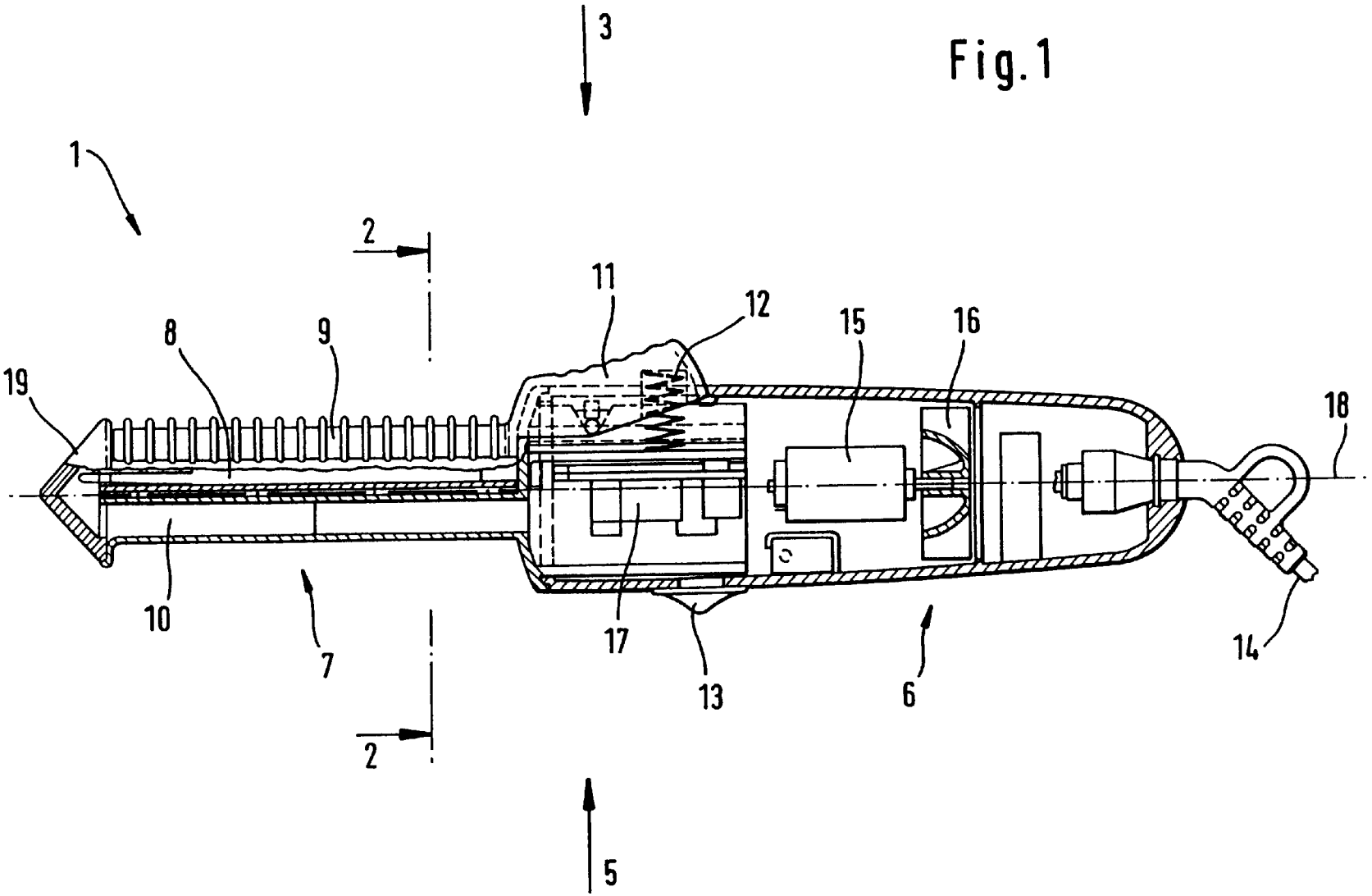
FIG. 1 is a systematic longitudinal cross-sectional view of a hair styling appliance.

A hair styling appliance 1 (FIG. 1) of the present invention generally includes a handle portion 6 and a styling member 7 which, in turn, includes a heating portion 8, a cooling portion 10, and a clip 9. A cover 19 is provided at the front tip of the appliance 1. At its rear end, clip 9 has a push button 11 which is supported in the handle portion 6 by way of a spring element 12.

An electric switch 13 for switching the appliance on and off is arranged on the outside surface of the handle portion 6 opposite to the push button 11. A cable 14 for the mains connection of the appliance is provided at the rear end of the handle portion 6. The interior of the handle portion 6 houses a motor 15 for driving a fan wheel 16, and a plate bar 17 with control appliances. The motor 15 can be driven alternatively by way of electrical voltage dividers, or e.g. by a battery. The hair styling appliance 1 has a generally symmetric configuration about its main axis 18.

The styling member 7 (FIG. 2) has a substantially elliptical cross-section which is formed of two halves having essentially the same size. The mean diameter of a styling member 7 advantageously ranges between 15 and 40 mm approximately. One half (the bottom one) is a cooling portion 10, the top half is a heating portion 8. There is provision of an arcuate clip 9 on the top side of the heating portion 8.

Figure 2:
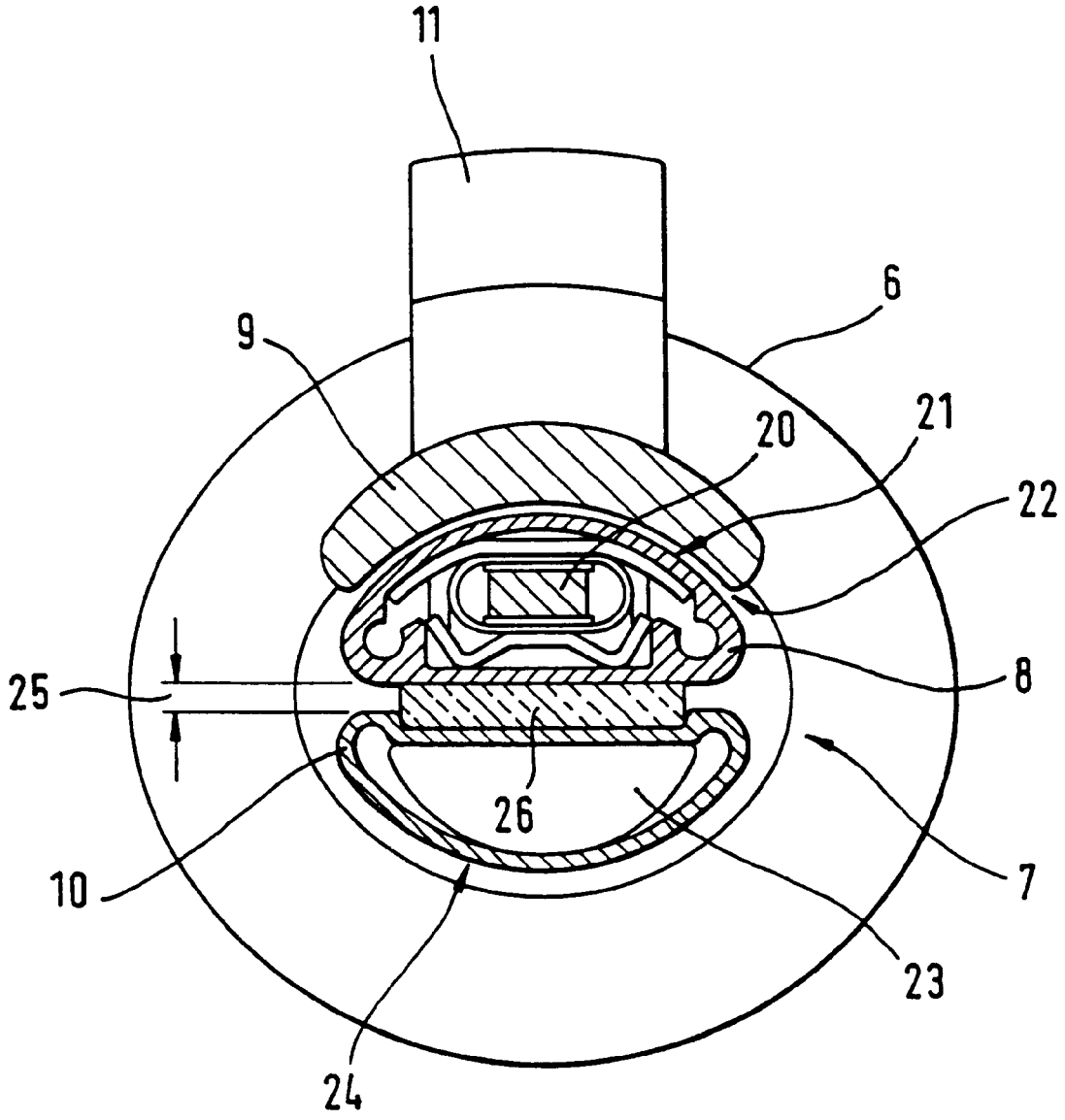
FIG. 2 is an enlarged view of a styling member, in a cross-section taken along line 2—2 in FIG. 1.

A PTC element 20 is arranged in the interior of the heating portion 8. The dome-shaped outside surface of the heating portion 8 forms the heating zone 21 which, in the unloaded condition of the appliance, i.e., in the absence of hair placed between the heating portion 8 and the clip 9, bears directly against the inside of the clip 9 in a favorable manner. However, it is also possible to attach the clip 9 so that it has a gap 22 relative to the heating zone 21, as illustrated in FIG. 2. The heating portion 8 and the clip 9 have surfaces which are opposite to one another and substantially congruent in shape. Further, the clip 9 is favorably made of a heat-conductive material, e.g. aluminum, so that the clip 9 may also be heated indirectly by the heating portion 8, with the result of permitting heating both sides of a strand of hair which is to be placed into the interspace between the heating portion 8 and the clip 9.

Inside the cooling portion 10 is a cooling channel 23 which penetrates the length of the cooling portion. The dome-shaped outside surface of the cooling portion 10 forms the cooling zone 24. The cooling air propagates from the fan wheel 16 into the interior of the cooling portion 10 and from there to the outside through radial openings (which are not shown for the sake of clarity). Advantageously, the outlet openings vary in their diameter in an axial direction in order to achieve a uniform air distribution along the cooling portion 10, that means, the openings are larger proximate the handle portion 6 than proximate the tip 19 of the appliance. As an alternative of the above-mentioned design with an active cooling, the member of the cooling portion 10 can also be provided as an aluminum member with a paraffin filling.

The two substantially plane inside surfaces of the heating portion 8 and the cooling portion 10 are arranged at a distance 25 relative to each other, which is preferably penetrated by air, but wherein also a thermal insulator 26 may be accommodated. It is thereby avoided that the cooling portion 10, too, is heated by the radiation heat of the heating portion. The surface temperature of the heating portion 8 advantageously amounts to 120 to 145° C. approximately. The cooling air which flows through the cooling channel 23 and is produced by the fan wheel 16, as shown in the representation of FIG. 1, will cool the cooling portion 10 basically to room temperature so that the temperature difference according to the present invention between the two surface temperatures of the heating zone 21 and the cooling zone 24 at least amounts to 80 kelvin.

The appliance illustrated in FIGS. 1 and 2 is comprised of a heating portion 8 and a cooling portion 10 with a substantially smooth outside surface, while the clip 9 has on its outside transverse ribs which extend substantially vertically relative to the main axis 18 of the appliance 1.

Figure 3:
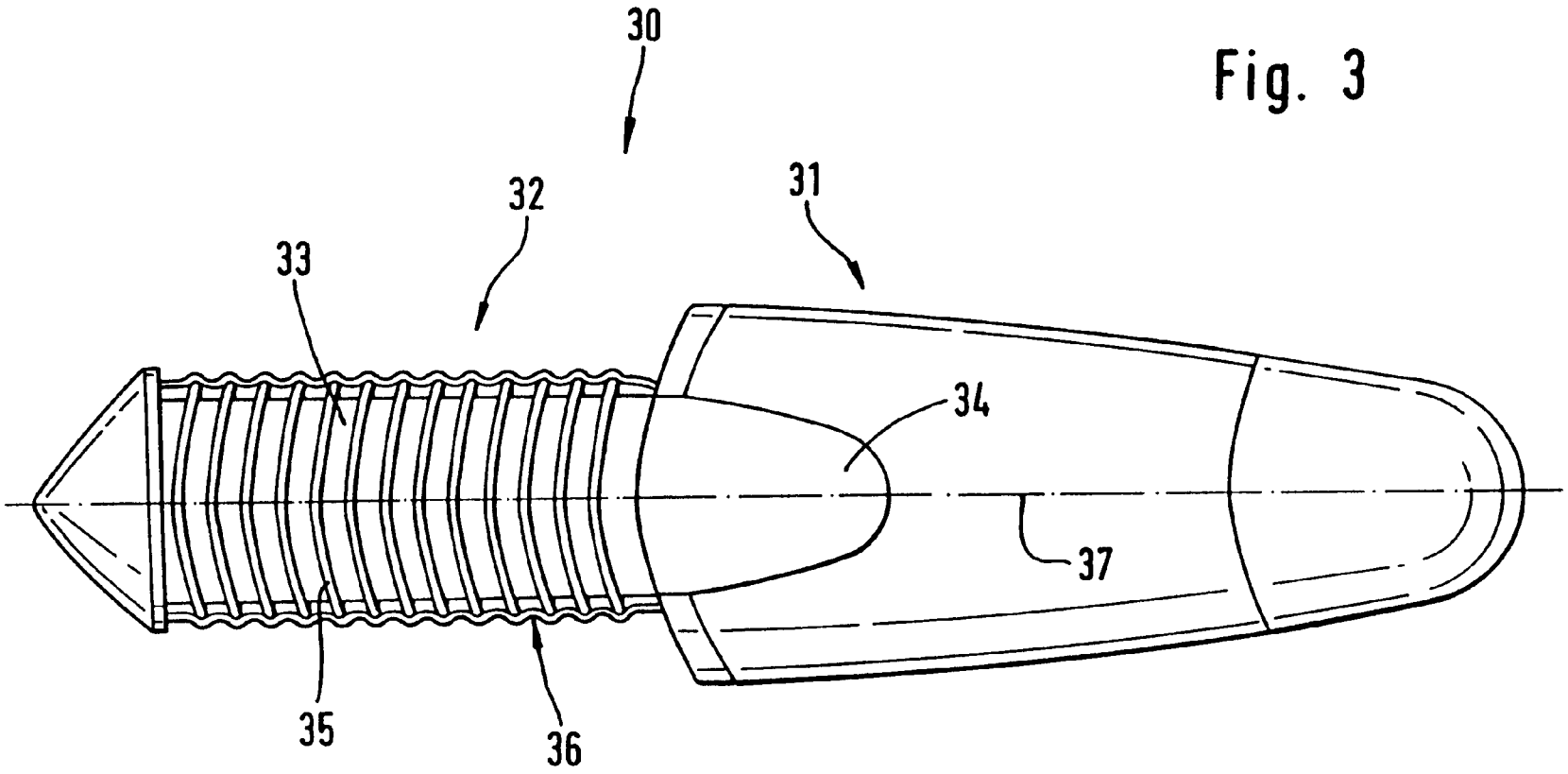
FIG. 3 is a top view of a hair styling appliance in an alternative embodiment with arrow-shaped ribs.

An alternative embodiment with respect to the hair styling appliance illustrated in FIGS. 1 and 2 is shown in a top view in FIG. 3, similar to the view 3 in FIG. 1. The appliance 30 basically includes a handle portion 31 and a styling member 32, and the clip 33 has arrow-shaped ribs 35 on its outside surface. Ribs 35 are arranged substantially symmetrically in relation to the main axis 37 of the appliance 30, and their tips point to the front end of the appliance. The two longitudinal edges of the clip 33 have undulated outside ribs 36. The purpose of the ribs 35 and 36 is to make a user aware of not pulling a strand of hair being styled over the ribbed outside surface of the clip 33. Clip 33 has a push button 34 for actuation at its rear end. The handle portion 31 has a roughly truncated-cone-shaped configuration which tapers continuously towards its rear end and is rounded at this rear end.

Figure 4:
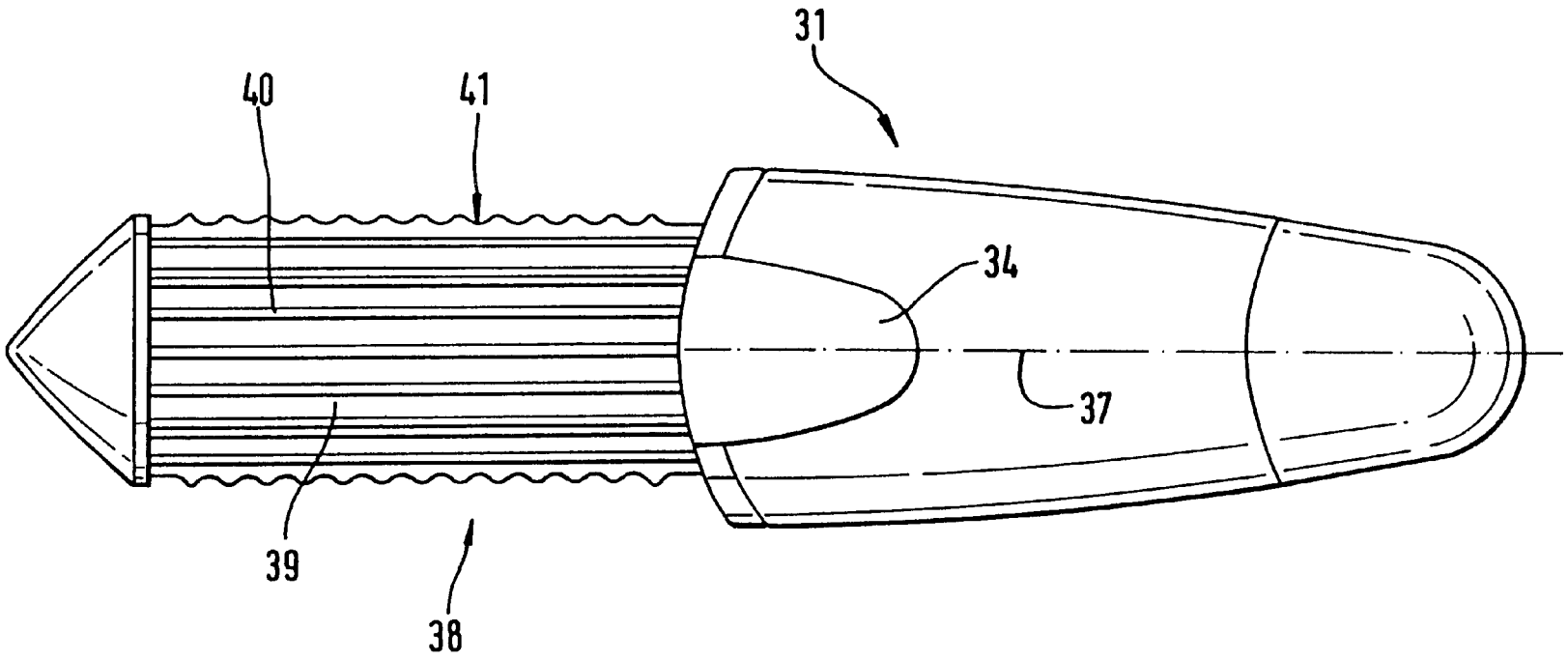
FIG. 4 is a top view of a hair styling appliance similar to the representation in FIG. 3, however, with longitudinal ribs.

Another alternative (FIG. 4) of the design of a hair styling appliance shown in FIG. 3 also includes a handle portion 31 with a main axis 37, however, the styling member 38 is furnished with longitudinal ribs 40 on the outside surface of the clip 39. The longitudinal ribs 40 extend substantially in parallel to the main axis 37, and their design is meant to prevent a user from wrapping hair around the styling member 38. The visual impression inducing a user not to pull the hair over the clip can still be augmented by undulated outside ribs 41 on the two longitudinal edges of the clip 39.

Figure 5:
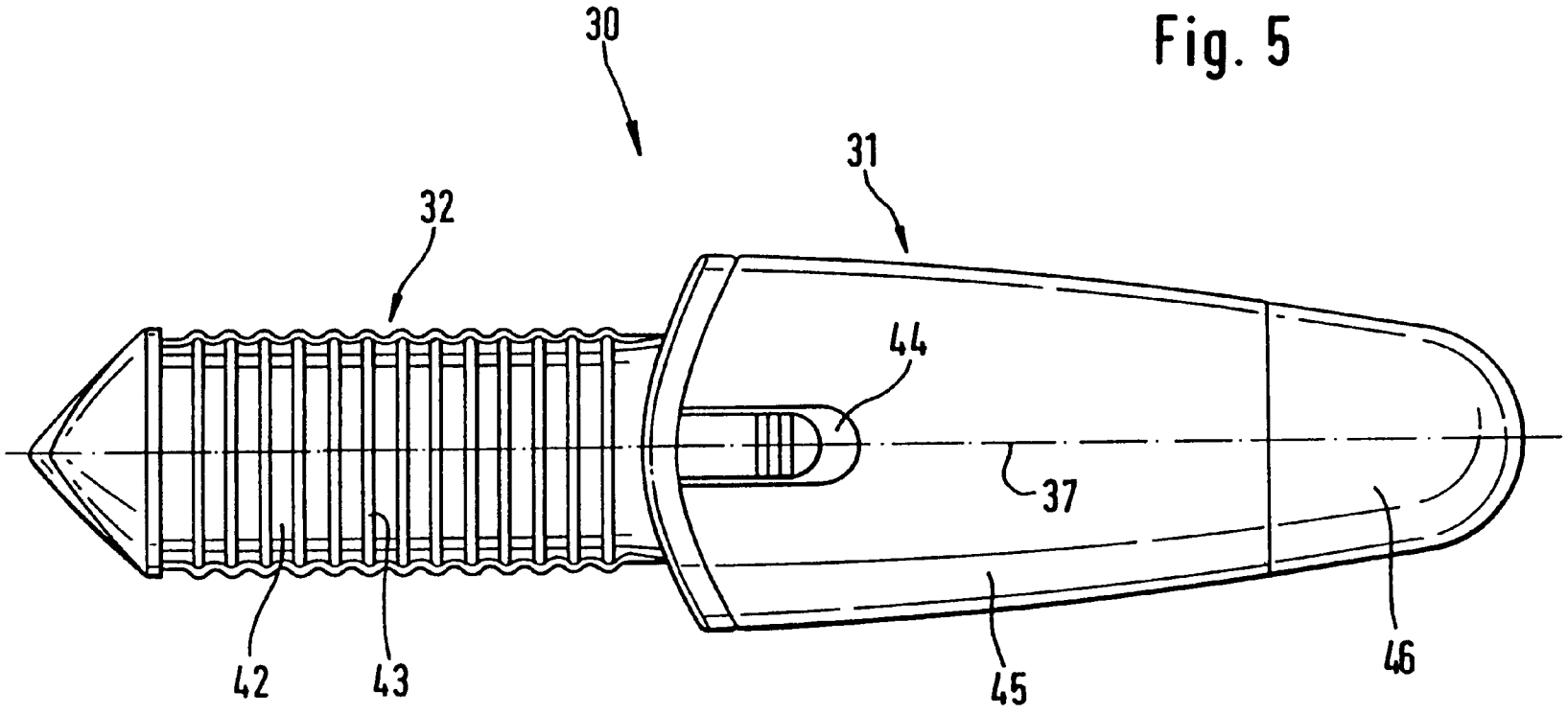
FIG. 5 is a bottom view of a hair styling appliance according to the representation in FIG. 3.

The bottom side of a hair styling appliance 30 according to FIG. 3 corresponds to an illustration in view 5 of FIG. 1. The embodiment of FIG. 5 shows a cooling portion 42 with transverse ribs 43 which extend substantially vertically to the main axis 37 of the appliance. Thus, ribs 43 form a number of parallel channels into which a strand of hair to be styled is placed and can be pulled tranversely to the main axis 37. A switch 44 which basically corresponds to the switch 13 of FIG. 1 is arranged at the front end of the handle portion 31.

Alternatively to the previously described electrical heating of a hair styling appliance of the present invention, the latter appliance may of course also be operated by means of a catalytic combustion of gas. It is favorable in such a case to accommodate a gas cartridge in the handle portion 31. For ease of fitting the gas cartridge into, or for its removal from, the handle portion 31, the latter may be split into a front casing shell 45 and a rear casing shell 46 that is removable therefrom.

In a side view (FIG. 6) of an appliance according to the illustration in FIGS. 3 and 5, one can see the handle portion 31 and the styling member 32, with the latter including the cooling portion 42 and the clip 33. The arrow-shaped ribs 35 on the outside surface of the clip 33 have a forward inclination. Close to their bottom end, the ribs 35 may still be interconnected by a longitudinal rib 47, with this impression preventing a user even more from pulling the hair strand being styled over the clip 33.

The cooling portion 42 includes a plurality of parallel ribs 43 which have a front and a rear boundary rib 48, 49. Ribs 48, 49 extend over the remaining intermediate ribs 43 at least in areas in a radial direction. Channels 50 for guiding the hair strand being styled are provided intermediate the individual ribs 43, 48, and 49.

Figure 6:
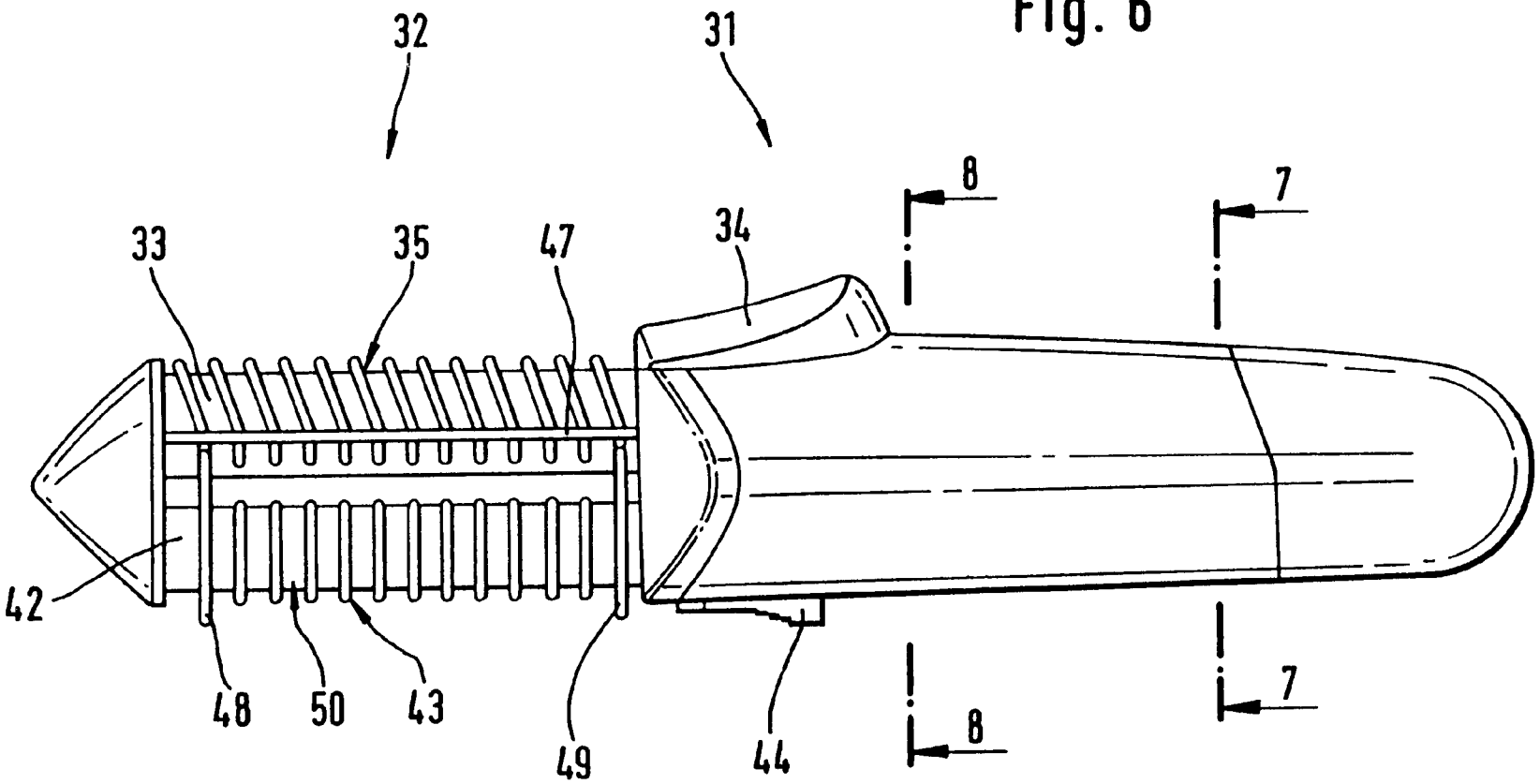
FIG. 6 is a side view of a hair styling appliance according to the representation in FIGS. 3 and 5.
Figure 7:
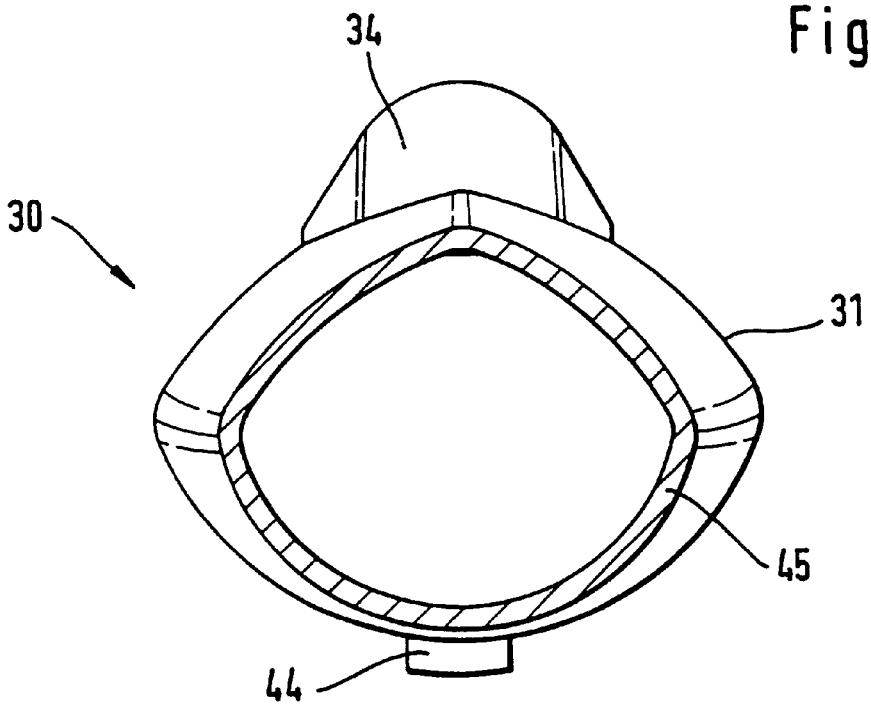
FIGS. 7 and 8 are views of a hair styling appliance taken along portions 7—7 and 8—8 in FIG. 6.
Figure 8:
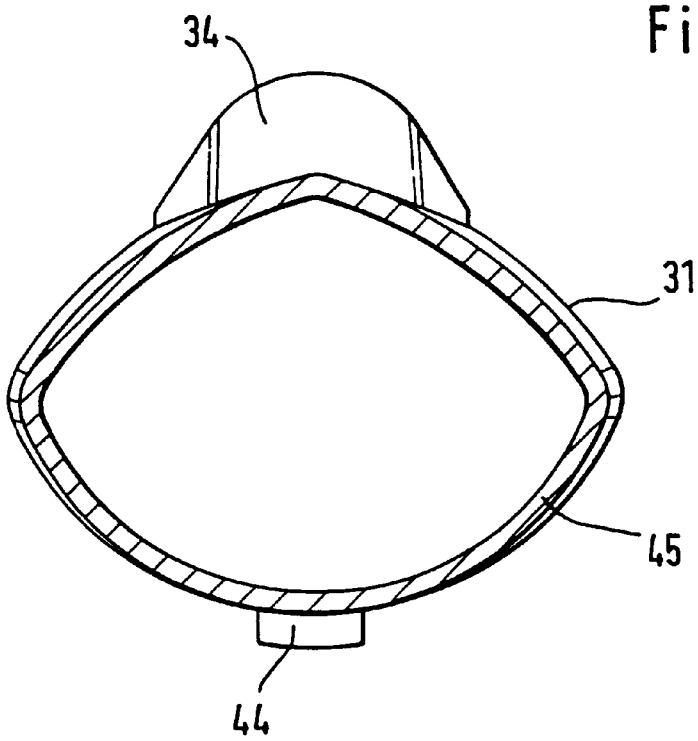

It can be seen in a cross-section (FIG. 7, FIG. 8) taken along the lines 7—7 and 8—8 in FIG. 6 that the cross-sectional surface of the casing shell 45 increases from the rear to the front end of the handle portion 31. The handle portion 31 is provided with push button 34 on its top side and switch 44 on its bottom side.

Figure 9:
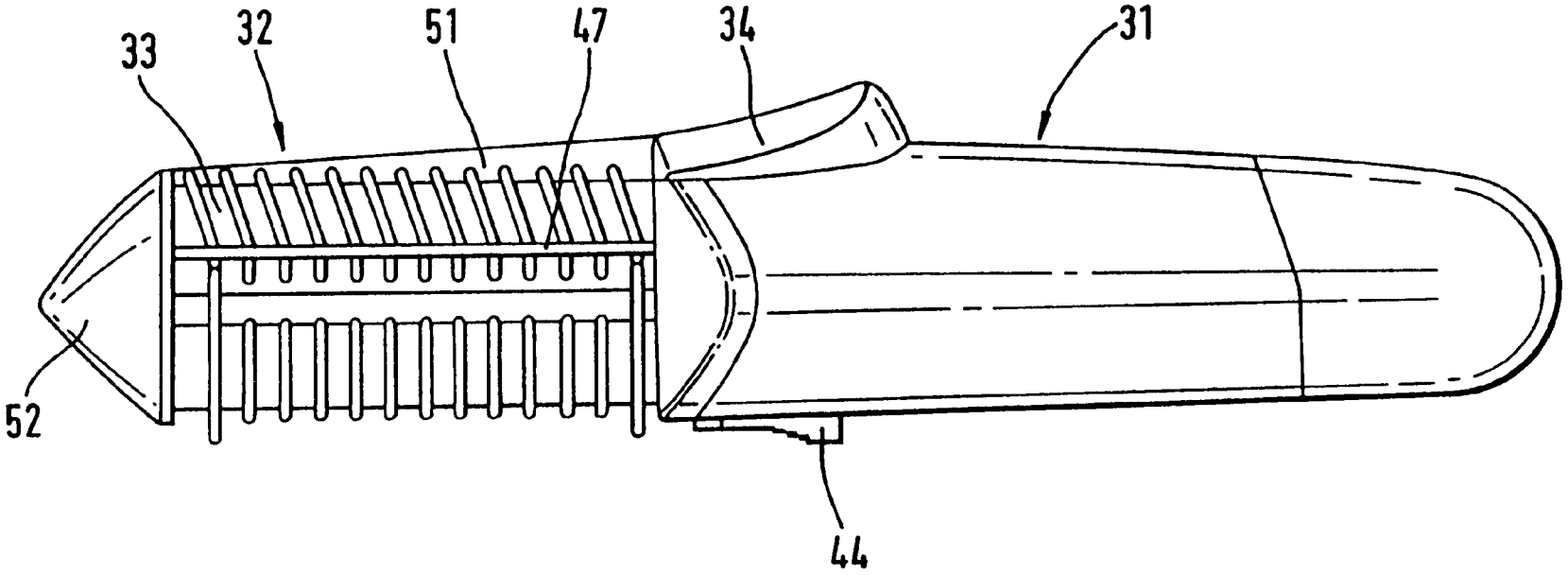
FIG. 9 is a side view of a hair styling appliance similar to the representation in FIG. 6, however, with a longitudinal rib on the back side of the clip.

An improvement upon a hair styling appliance (FIG. 9) according to the illustration in FIG. 6 basically includes the handle portion 31 with push button 34 and switch 44. In contrast to the illustration according to FIG. 6, a vane-shaped longitudinal rib 51 is provided on the top side of the clip 33. Rib 51 joins in between the tip 52 and the push button 34 so that it ascends towards the handle portion 31. A longitudinal rib 51 of this type in combination with the longitudinal rib 47 still intensifies the awareness of a user not to place or pull a hair strand being styled across the surface of the styling member 32.

Figure 10:
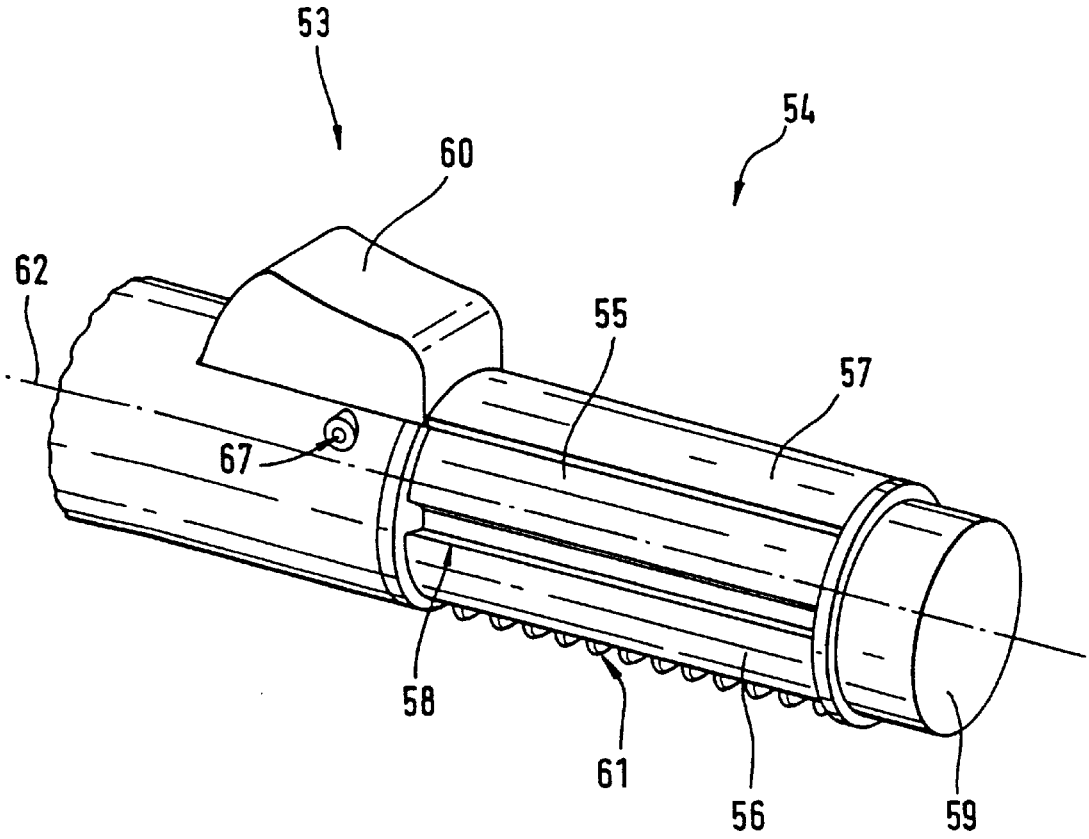
FIG. 10 is a perspective view of a styling member for a hair styling appliance in an alternative embodiment.

Another alternative design of a hair styling appliance according to the present invention (FIG. 10) basically includes a handle portion 53 and a styling member 54. The latter styling member 54, in turn, is comprised of a heating portion 55 and a cooling portion 56 which are separated from each other by a longitudinal gap 58, into which also a thermal insulator may be inserted. Arranged on the top side of the heating portion 55 is a clip 57 with push button 60, and by pushing the button 60 the clip 57 is adapted to be pivoted about a pin 61. This renders it possible to place a hair strand being styled into the wedge-shaped interspace which is then produced between the clip 57 and the heating portion 55. In its area diametrally opposite to the clip 57, the cooling portion 56 has ribs 61 which extend substantially transversely to a main axis 62 of the appliance. What is characteristic of the representation shown in FIG. 10 is the generally circular cylindrical shape of the styling member 54 which becomes also apparent from the bowl shape of the frontal cover 59.

Figure 11:
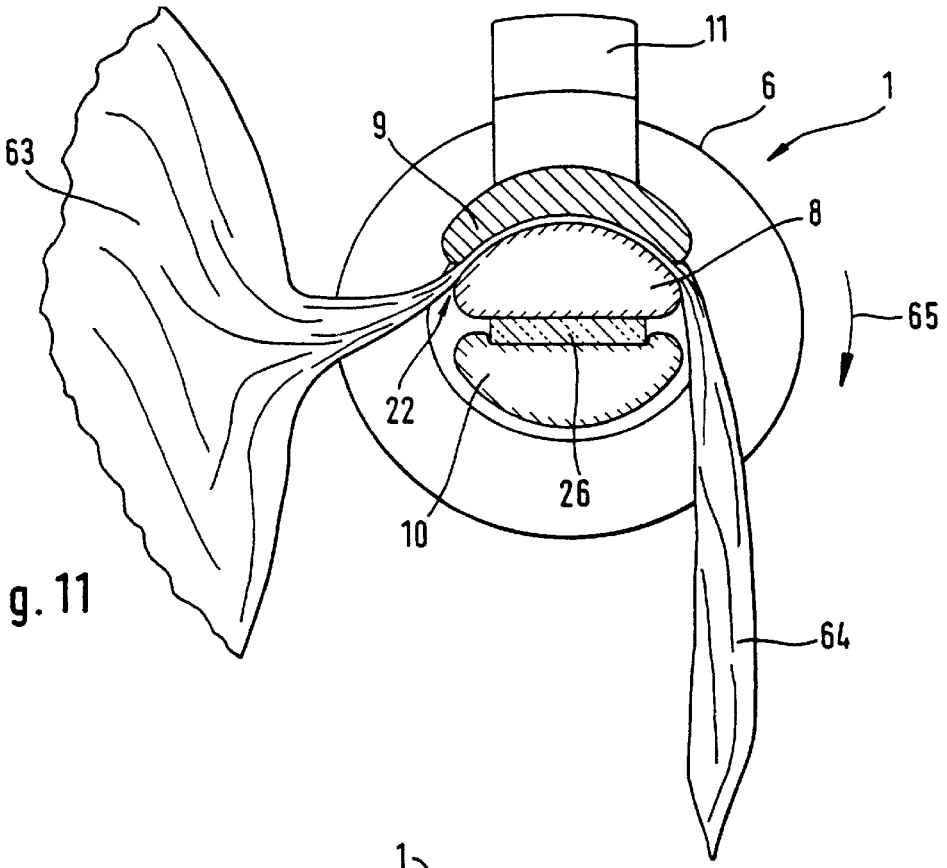
FIG. 11 is a view of a styling member similar to the representation in FIG. 2, however, with a strand of hair inserted.
Figure 12:
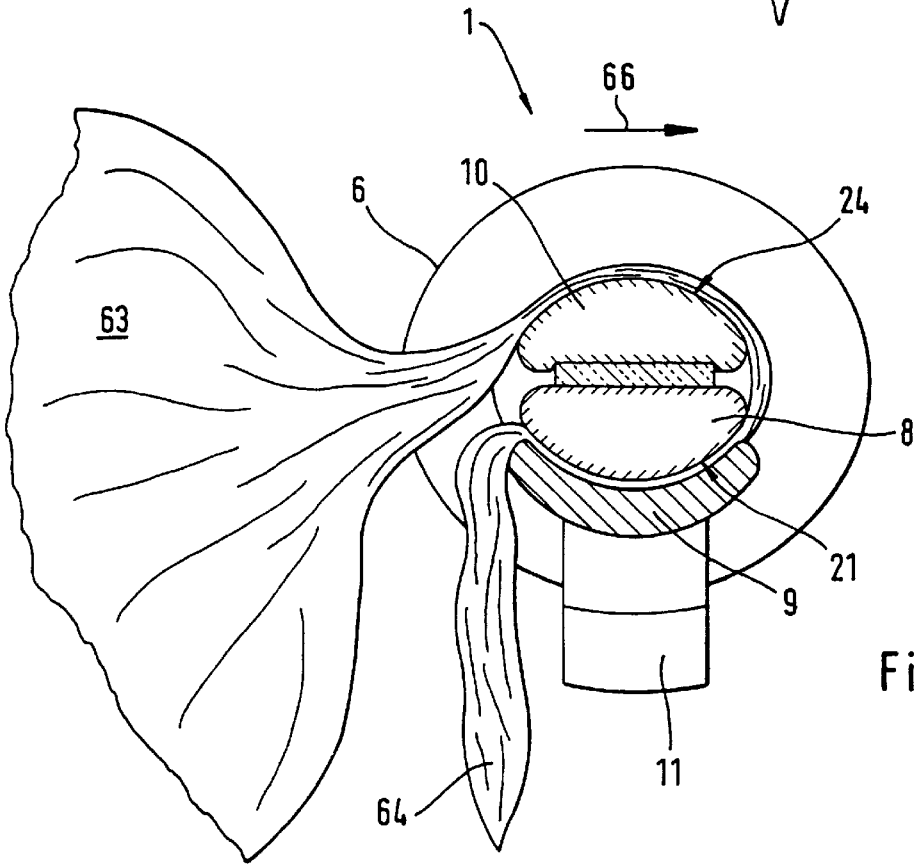
FIG. 12 is a view of a styling member similar to FIG. 11, however, in a representation which is turned by 180° with respect to FIG. 11.

The typical mode of operation of the hair styling appliance of the present invention is illustrated in FIGS. 11 and 12. A hair strand 64 being styled close to the hair roots 63 is placed into gap 22 and clamped in between the heating portion 8 and the clip 9. Initially, the push button 11 is on the upward directed side of the appliance. Subsequently, a user will turn the handle portion 6 by about 180° in the direction of rotation 65 so that the push button 11 (FIG. 12) will be placed on the bottom side of the appliance. In this arrangement, the hair strand 64 being styled is urged by the clip 9 against the heating zone 21 of the heating portion 8, on the one hand. On the other hand, the strand 64 is placed at the cooling zone 24 of the cooling portion 10. To produce curls, the hair styling appliance is now pulled away from the hair roots 63 in the direction of movement 66. In doing so, the hair strand 64 being styled is first heated at the heating zone 21, styled, and thereafter slides over the cooling zone 24 of the cooling portion 10, with the curl produced between the heating portion and the clip becoming "frozen" due to the temperature difference according to the present invention between the heating portion 8 and the cooling portion 10.

What is claimed is:

1. A hair styling appliance comprising:

a handle portion;

a heating portion extending from said handle portion, said heating portion having a heating zone for heating and styling curls or waves of hair; and a cooling portion extending adjacent said heating portion, said cooling portion having a cooling zone for cooling the hair, wherein, during operation, a temperature difference between a first surface temperature associated with the heating zone and a second surface temperature associated with the cooling zone amounts to at least 80 kelvin.

2. The hair styling appliance of claim 1, wherein the heating portion and the cooling portion together provide a styling member for hair treatment which generally has one of a circular and an elliptical cross-sectional surface, and the heating and cooling portions have a substantially equal cross-sectional area.

3. The hair styling appliance of claim 1, wherein each of the heating and cooling portions has an outer surface and an inner surface, the outer surface of the heating portion forming the heating zone, the outer surface of the cooling portion forming the cooling zone, the inside surface of each of the heating and cooling portions being generally planar and arranged so as to be opposite and spaced from each other by a distance of between approximately 1.5 and 3 mm.

4. The hair styling appliance of claim 1, wherein a thermal uncoupling element is provided between the heating portion and the cooling portion.

5. The hair styling appliance of claim 1, wherein a hair retaining clip for producing a pressing force onto the hair is provided, with the hair adapted to be placed between the heating portion and the hair retaining clip.

6. The hair styling appliance of claim 5, wherein one end of the hair retaining clip is movably coupled to one of the handle portion and the heating portion by a pivot, the hair retaining clip being urged by a spring element to one of a position against the heating zone of the heating portion and a position forming a substantially uniform gap between the hair retaining clip in its inactive position and the heating portion.

7. The hair styling appliance of claim 6, wherein the hair retaining clip is made of a heat-conducting material and is indirectly heatable by the heating portion.

8. The hair styling appliance of claim 1, wherein the heating portion comprises a member made of an appropriate heat conducting material having a surface temperature which at least in the area of the heating zone amounts to more than 120° C.

9. The hair styling appliance of claim 1, wherein the heating portion includes one of an electric heating element and a gas heating appliance.

10. The hair styling appliance of claim 1, wherein the cooling portion comprises a member made of one of metal and plastic, the cooling portion having at least one of a heat-conducting coating and cooling ribs.

11. The hair styling appliance of claim 1, wherein the cooling portion comprises a cooling member that can be cooled actively by one of cooling air and a Peltier element.

12. The hair styling appliance of claim 1, wherein at least one of the heating portion, the cooling portion and the hair retaining clip has ribs on an outer surface thereof for guiding and/or spacing.

13. The hair styling appliance of claim 12, wherein the ribs are arranged substantially transversely to a main axis of the appliance, adjacent ribs forming a circumferential channel.

14. The hair styling appliance of claim 13, wherein at least one boundary rib is provided.

15. The hair styling appliance of claim 13, wherein two external ribs are designed as boundary ribs and project beyond ribs positioned intermediate the boundary ribs, at least in areas, in a plane transverse to the main axis of the appliance.

16. The hair styling appliance of claim 12, wherein the ribs are provided on the hair retaining clip, in one of a bow-shaped, waved and arrow-shaped configuration.

17. The hair styling appliance of claim 12, wherein the ribs are arranged generally in parallel to the main axis of the appliance.

18. The hair styling appliance of claim 12, wherein the ribs extend substantially radially away from the main axis of the appliance.

19. The hair styling appliance of claim 1, wherein the handle portion of the appliance has one of a generally elliptical and a generally oval contour in a plane that is vertical to a main axis of the appliance.

20. The hair styling appliance of claim 19, wherein the cross-sectional surface of the handle portion decreases continuously from a front end towards a rear, free end.

21. A method of styling hair with a hair styling appliance, the method comprising:

initially heating a hair strand that is to be styled at a heating zone of a heating portion of the appliance, the heating portion being shaped by a domeshaped surface of the heating zone; and subsequently cooling the hair strand at a cooling zone of the appliance, wherein a surface temperature of the heating zone differs from a surface temperature of the cooling zone by at least 80 kelvin.

22. The method of claim 21, wherein the hair is heated in the heating zone at least to a styling temperature of approximately 120° C., with a relative moisture in the hair of 30% approximately, and the surface temperature of the heating zone is preferably set to 145° C. approximately.

23. The method of claim 21, wherein the hair is pulled in a tightened condition over the heating zone and the cooling zone.

24. The method 23, wherein the hair is placed into a clamping area between a hair retaining clip and the heating portion, a clamping force is applied to the hair being styled, and the hair is then pulled through the clamping area and thereafter along the cooling zone.

25. The method of claim 24, wherein a direction of movement of the hair just prior to being heated in the heating zone is equal to the direction of movement of the hair in the heating zone.

26. The method of claim 25, wherein a relative speed between the hair styling appliance and the hair is variable.

27. The method of claim 26, wherein straight hair is curled.

28. The method of claim 26, wherein curled hair is straightened.

29. The method of claim 26, wherein the hair is placed into the clamping area between the heating portion and the hair retaining clip, and the hair styling appliance is turned about its main axis by roughly 120° to 180° so that the hair will bear against the heating zone and at least in areas against the cooling zone of the cooling portion, and subsequently the hair styling appliance is moved away from a head of a user so that the hair is cooled at the cooling zone of the cooling portion.

30. The hair styling appliance of claim 1, wherein the heating zone is domeshaped.

31. The hair styling appliance of claim 1, wherein said temperature difference amounts to at least 100 kelvin.

32. The method of claim 21, wherein the surface temperature of the heating zone differs from the surface temperature of the cooling zone by at least 100 kelvin.

* * * * *